US008713810B2

(12) United States Patent
Spaulding

(10) Patent No.: US 8,713,810 B2
(45) Date of Patent: May 6, 2014

(54) CHALK BOX

(75) Inventor: James Spaulding, Bristol, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 210 days.

(21) Appl. No.: 13/198,367

(22) Filed: Aug. 4, 2011

(65) Prior Publication Data

US 2012/0260511 A1 Oct. 18, 2012

Related U.S. Application Data

(60) Provisional application No. 61/475,152, filed on Apr. 13, 2011.

(51) Int. Cl.
*B44D 3/38* (2006.01)

(52) U.S. Cl.
USPC ..... 33/414

(58) Field of Classification Search
USPC ..... 33/414
See application file for complete search history.

(56) References Cited

U.S. PATENT DOCUMENTS

| | | | | | |
|---|---|---|---|---|---|
| 997,831 | A * | 7/1911 | Kiso | 33/414 |
| 1,557,031 | A * | 10/1925 | Conway | 33/414 |
| 1,567,976 | A * | 12/1925 | Myers | 33/414 |
| 2,749,618 | A * | 6/1956 | Landon | 33/414 |
| 3,438,595 | A * | 4/1969 | West et al. | 242/394 |
| 3,888,010 | A | 6/1975 | Hyde et al. | |
| 4,143,462 | A * | 3/1979 | Gertz | 33/414 |
| 5,444,919 | A * | 8/1995 | Alves | 33/414 |
| 5,470,029 | A * | 11/1995 | Dufour | 242/394 |
| 5,493,787 | A | 2/1996 | Owens | |
| 5,644,852 | A | 7/1997 | Fuller et al. | |
| 5,920,997 | A | 7/1999 | Girtman | |
| 6,098,299 | A | 8/2000 | Collins et al. | |
| 6,289,597 | B1 | 9/2001 | Beyers | |
| 6,393,709 | B1 | 5/2002 | Jones | |
| 6,484,412 | B1 | 11/2002 | Donaldson et al. | |
| 6,910,280 | B2 * | 6/2005 | Scarborough | 33/768 |
| 6,915,587 | B1 | 7/2005 | Scillia et al. | |

(Continued)

FOREIGN PATENT DOCUMENTS

| | | |
|---|---|---|
| DE | 800 825 | 12/1950 |
| DE | 947 595 | 8/1956 |

(Continued)

*Primary Examiner* — Christopher Fulton
(74) *Attorney, Agent, or Firm* — Pillsbury Winthrop Shaw Pittman LLP

(57) ABSTRACT

A chalk box includes a housing with an opening and a rotatable reel disposed within the housing. An elongated line is arranged to be wound on the reel. A reel winder is arranged to rotate the reel to wind the line on the reel. A movable cover is mounted to the housing and is movable between an open position and a closed position, the cover when open permits a powder or a fluid marker material to be placed into the housing through the opening in the housing. The movable cover includes an elastomeric material enabling the cover to seal with the housing when the cover is closed to prevent leakage of the marker material at an interface between the movable cover and the housing. A releasable lock is arranged to releasably lock the cover in the closed position, the releasable lock being manually manipulable by a user's fingers to release the lock to permit access into the housing through the opening. The elastomeric material is overmolded onto and thus permanently connected to the relatively rigid material of the movable cover.

21 Claims, 9 Drawing Sheets

(56) References Cited

U.S. PATENT DOCUMENTS

| | | | | |
|---|---|---|---|---|
| 6,957,495 | B1 * | 10/2005 | Schmillen | 33/414 |
| 7,197,831 | B2 * | 4/2007 | Nepil | 33/414 |
| 7,478,484 | B2 | 1/2009 | Nepil et al. | |
| 7,536,799 | B2 | 5/2009 | Nepil et al. | |
| 7,536,800 | B2 | 5/2009 | Nepil et al. | |
| 7,624,509 | B2 * | 12/2009 | Hanson et al. | 33/414 |
| 7,770,300 | B2 | 8/2010 | Johnson | |
| RE41,620 | E | 9/2010 | Scillia et al. | |
| 7,913,408 | B2 | 3/2011 | Grisham | |
| 2006/0144985 | A1 | 7/2006 | Whitney | |
| 2007/0068021 | A1 | 3/2007 | Fisher | |
| 2007/0240320 | A1 * | 10/2007 | Hickey et al. | 33/414 |
| 2008/0236442 | A1 | 10/2008 | Spaulding et al. | |

FOREIGN PATENT DOCUMENTS

| | | | |
|---|---|---|---|
| DE | 1 785 114 | | 3/1959 |
| DE | 1 833 932 | | 6/1961 |
| DE | 1 911 932 | | 3/1965 |
| DE | 6 752 396 | | 2/1969 |
| DE | 24 45 610 | | 6/1975 |
| DE | 91 03 323 | | 4/1992 |
| DE | 44 45 456.2 | | 6/1996 |
| DE | 197 08 244 | | 9/1997 |
| DE | 200 15 210 | | 4/2001 |
| EP | 1 831 091 | B1 | 2/2001 |
| EP | 1 543 994 | A2 | 6/2005 |
| WO | WO 95/32143 | | 11/1995 |
| WO | WO 01/34410 | A1 | 5/2001 |
| WO | WO 03/101763 | A2 | 12/2003 |

* cited by examiner

CHALK BOX

CROSS REFERENCE TO RELATED APPLICATIONS

This application claims priority to U.S. Provisional Application Ser. No. 61/475,152, filed Apr. 13, 2011, the entire contents of which are incorporated by reference.

BACKGROUND

Field

The present disclosure relates to a chalk box.

A chalk box is a device or apparatus used to provide chalk marks (lines) on a work surface, e.g., a concrete surface. The chalk box includes a string or a line on which chalk material (typically powder) can be provided. The chalk material is transferred to the work surface by picking/plucking the line after it has been made taut over the surface to be marked. The line can be wound into the chalk box housing for storage. The chalk box stores the chalk material as well as the line, and can be refilled with additional chalk material when the chalk material runs out.

The present disclosure provides improvements over prior art chalk boxes.

SUMMARY

One aspect of the disclosure relates to a chalk box including a housing with an opening and a rotatable reel disposed within the housing. An elongated line is arranged to be wound on the reel. A reel winder is arranged to rotate the reel to wind the line on the reel. A movable cover is mounted to the housing and is movable between an open position and a closed position, the cover when open permits a powder or a fluid marker material to be placed into the housing through the opening in the housing. The movable cover includes an elastomeric material and a relatively rigid material, the elastomeric material enabling the cover to seal with the housing when the cover is closed to prevent leakage of the marker material at an interface between the movable cover and the housing through the opening. The elastomeric material is overmolded onto and thus permanently connected to the relatively rigid material of the movable cover. A releasable lock is arranged to releasably lock the cover in the closed position, the releasable lock being manually manipulable by a user's fingers to release the lock to permit access into the housing.

Another aspect of the disclosure relates to a chalk box including a housing having an opening. A movable cover is attached to the housing, the movable cover arranged to move between an open position and a closed position to selectively permit or prevent access to an interior of the housing through the opening. A rotatable reel is disposed within the housing. A windable line has a portion thereof wound on the reel and another portion thereof extending through a hole in the movable cover to the outside of the housing. The opening in the housing is positioned and sized to enable the user to manually engage the portion of the line wound on the reel therethrough when the cover is in the open position, the opening also permitting chalk or other marker material to be placed into the housing therethrough when the cover is in the open position.

Yet another aspect of the disclosure relates to a chalk box that includes a housing with an opening. A rotatable reel is disposed within the housing and an elongated line arranged to be wound on the reel. A reel winder is arranged to rotate the reel to wind the line on the reel. A pivotable cover is mounted to the housing and is movable between an open position and a closed position, the pivotable cover having an opening therethrough to provide an outlet for the line. The pivotable cover when open permits a powder or a fluid marker material to be placed into the housing through the opening in the housing. A releasable lock is arranged to releasably lock the cover in the closed position, the releasable lock is manually manipulable by a user's fingers to release the lock to permit access into the housing.

These and other aspects of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one aspect of the disclosure, the structural components illustrated herein can be considered drawn to scale. It is to be expressly understood, however, that the drawings are for the purpose of illustration and description only and are not intended as a definition of the limits of the disclosure. It shall also be appreciated that the features of one aspect disclosed herein can be used in other aspects disclosed herein. As used in the specification and in the claims, the singular form of "a", "an", and "the" include plural referents unless the context clearly dictates otherwise.

DETAILED DESCRIPTION

Figure 1A:
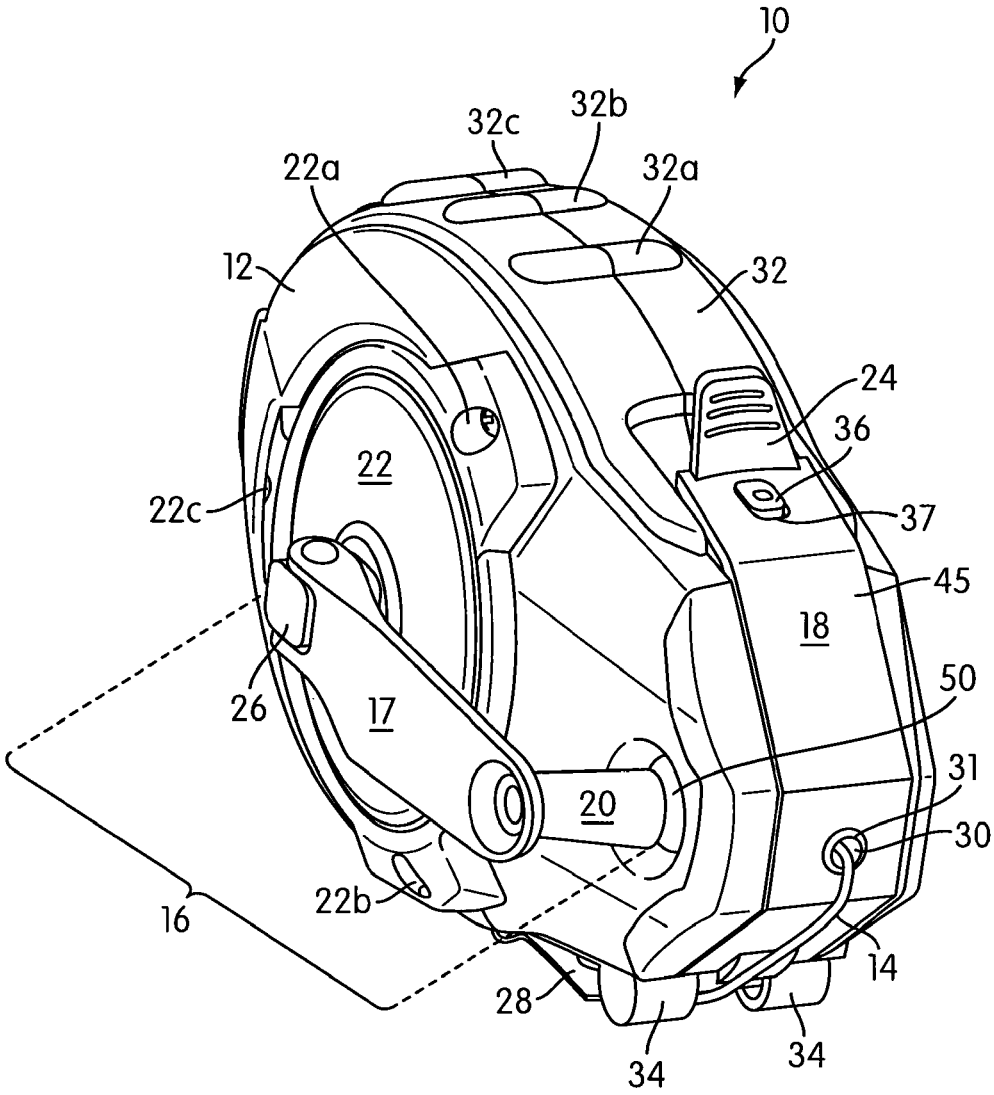
FIG. 1A shows isometric views of a chalk box, in accordance with an aspect of the present disclosure.
Figure 1B:
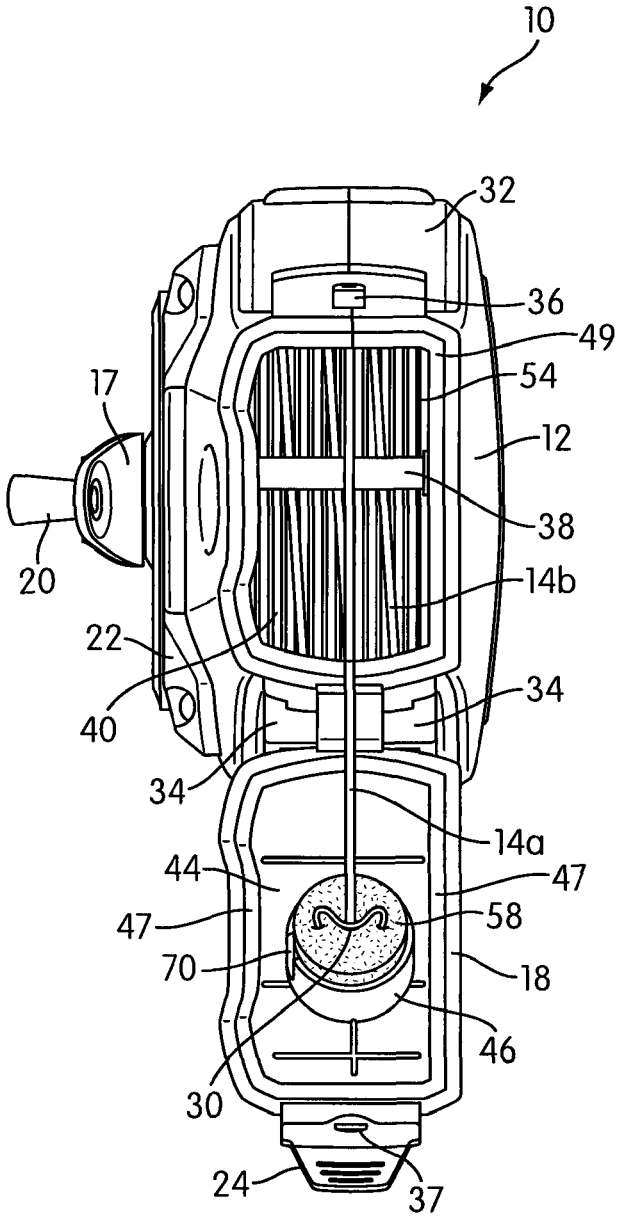
FIG. 1B shows another view of the chalk box with the cover open, in accordance with an aspect of the present disclosure.
Figure 3:
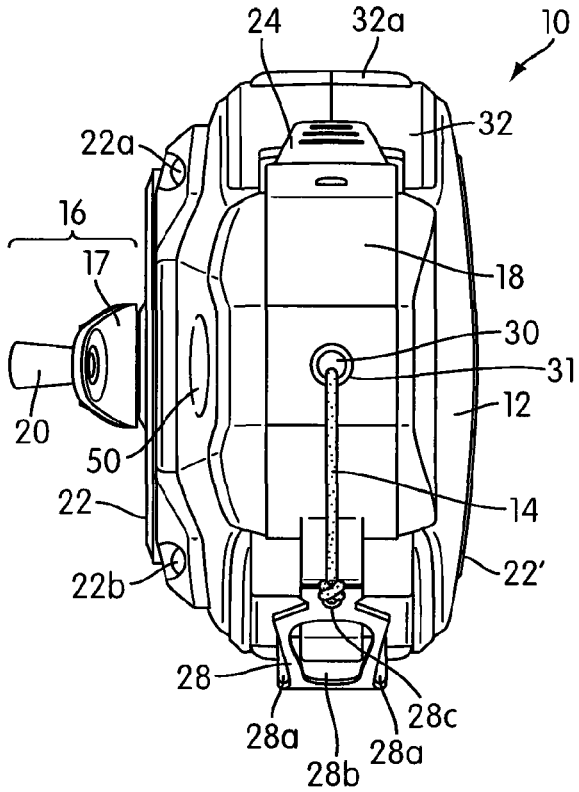
FIG. 3 shows a front view of the chalk box, in accordance with an aspect of the present disclosure.
Figure 5A:
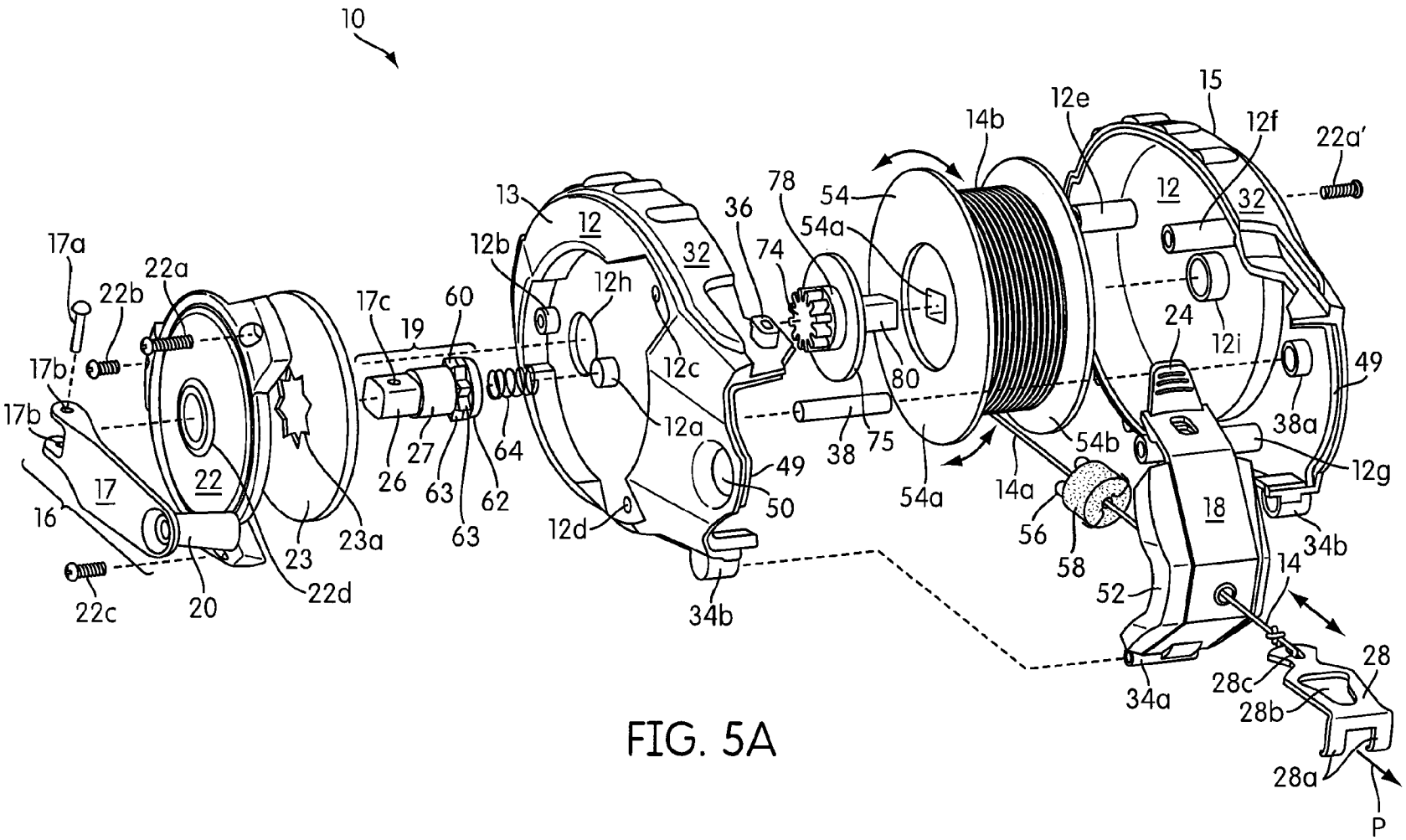
FIG. 5A shows an exploded view of the chalk box, in accordance with an aspect of the present disclosure.

A chalk box 10 in accordance with one aspect of the disclosure is shown in FIGS. 1A and 1B. FIGS. 1A and 1B are isometric views of chalk box 10 that includes a housing 12 and a movable cover 18 mounted on housing 12. In FIG. 1A, movable cover 18 is shown in the closed position, whereas in FIG. 1B movable cover 18 is shown in an open position. In one embodiment, the movable cover 18 may be pivotally connected to housing 12, although a slidable or rotatable cover is also contemplated. Nevertheless, movable cover 18 is interchangeably referred to herein as pivotable cover 18. Referring to FIG. 1A, mounted on the exterior of housing 12 is a reel winder 16 arranged to rotate a rotatable reel 54 (shown in more detail, e.g., in FIGS. 1B and 5A) disposed within housing 12. Reel winder 16 in one embodiment is constructed with an elongated part 17, a handle 20 at one end of elongated part 17, and a pivot structure 19 at the other end, with the mounting hub portion 26 of pivot structure 19 shown in FIG. 1A. Pivot structure 19 further includes a cylindrical portion 27 attached to the mounting hub portion 26 on one side and a gear member 60 having teeth 63 on another side (as best shown in FIG. 5A). The elongated part 17 is pivotally mounted on the mounting hub portion 26 of the pivot structure 19 by a pivot pin 17*a*, so that reel winder 16 can be moved from a rest position wherein a distal end of the handle 20 rests in a recess 50 on housing 12, to an operational position in which the distal end of handle 20 faces away from the housing 12 (e.g., as shown in FIG. 3). As best seen in FIG. 5A, a housing cap 22 is joined to housing 12 by a plurality of screws 22*a*-22*c*, although other mechanisms for fixing housing cap 22 to housing 12 (e.g., a latch mechanism), as well as other number of screws may be used.

Figure 7:
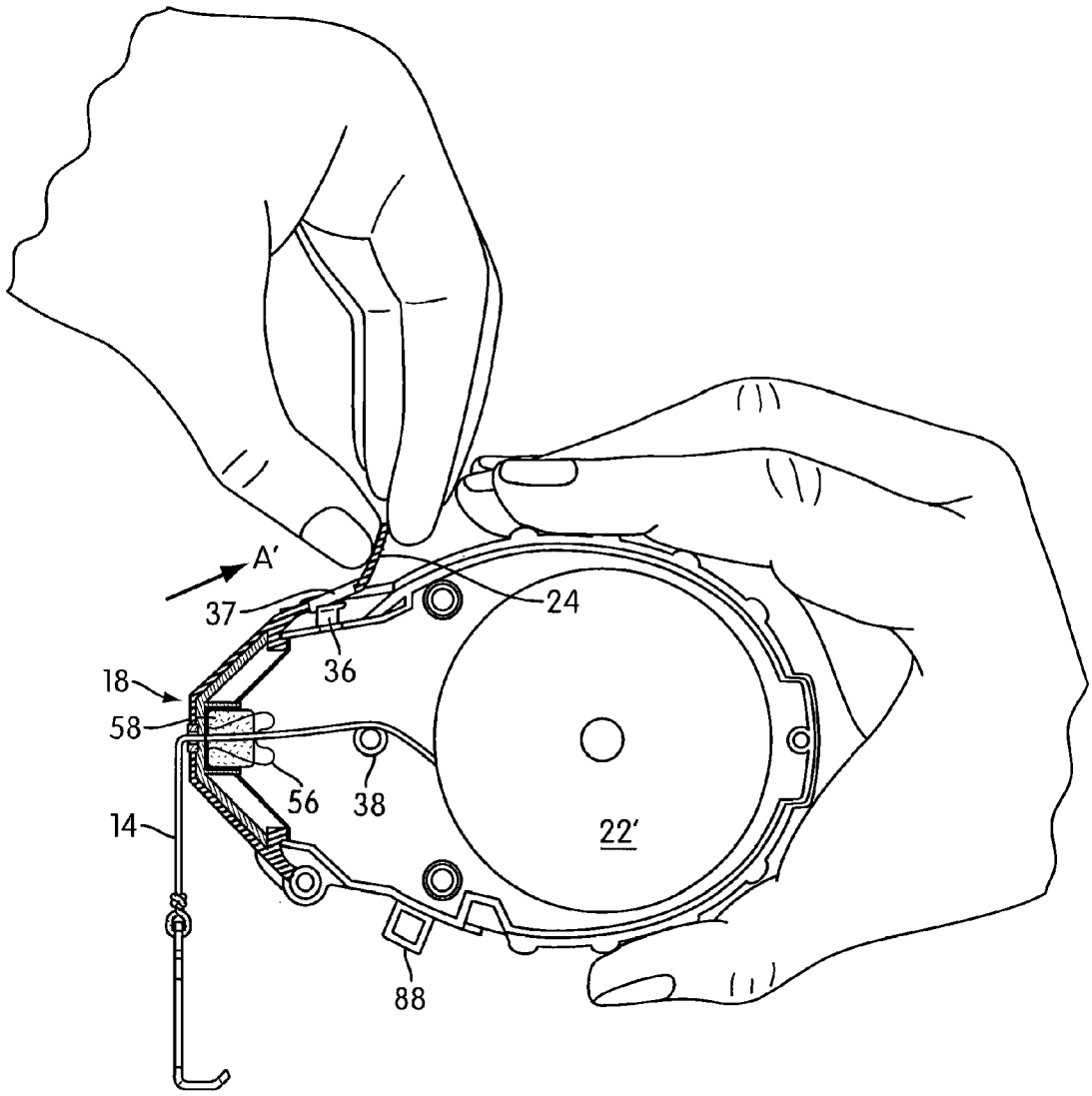
FIG. 7 shows an enlarged view of a projection formed on the housing and an opening in a tab formed on the movable cover, and shown being moved to releasably lock the cover in a closed position.
Figure 8:
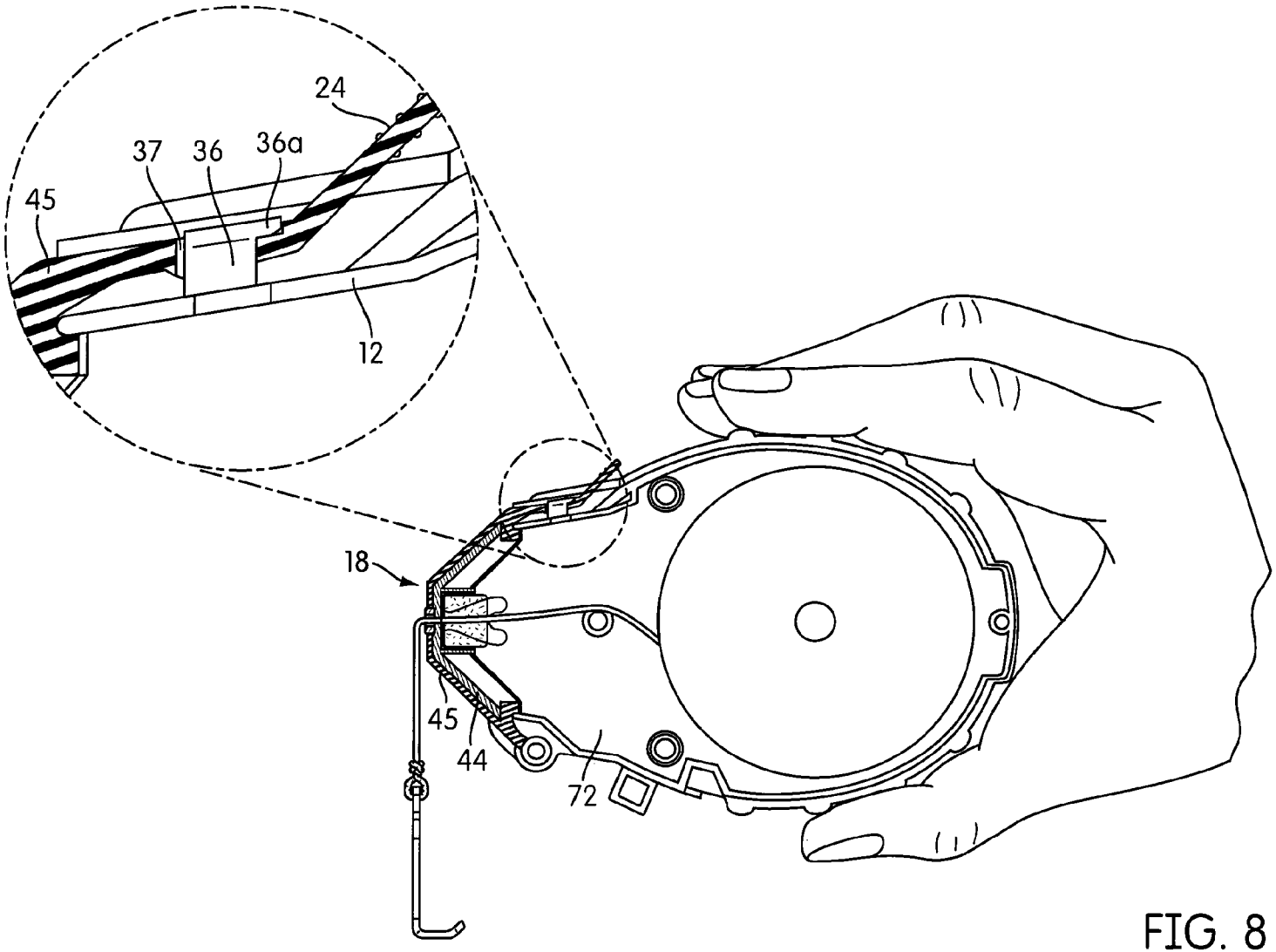
FIG. 8 is a close-up view of the movable cover in a locked or closed position with the housing, in accordance with an aspect of the present disclosure.

As best shown in FIGS. 7 and 8, for example, in one embodiment, movable cover 18 includes an elastomeric material 45 that forms an elastic tab 24 that can be stretched over a protrusion 36 on housing 12, so that protrusion 36 is received in a recess or opening 37 in the elastic tab 24 of movable cover 18 to lock the cover in a closed position relative to the housing 12. Elastic tab 24 is also referred to herein as a projection 24. The elastomeric material 45 of cover 18 can be formed of rubber, or other types of elastic or elastomeric material including but not limited to polysulphide rubber, polyacrilic rubber, silicone rubber, other types of unsaturated rubbers, saturated rubbers including but not limited to isopropene rubber; polybutadiene rubber, resilin, elastin, and the like, and combinations thereof. The engagement of protrusion 36 into opening 37 releasably locks the cover 18 in a closed position. As noted above, in this example, projection 24 forms a manually engageable tab that facilitates an opening and/or a closing of movable cover 18. The stretchability of elastomeric material 45 over protrusion 36 is sufficient to prevent accidental opening of movable cover 18, without a need for additional mechanism(s) to prevent such accidental opening of movable cover 18. In one embodiment, movable cover 18 is the only cover provided on housing 12 to seal an opening 40 into which chalk marker material can be filled, and/or through which an inside portion of housing 12 can be accessed by a user, as shown in FIG. 1B. It is to be noted that in chalk box 10, both (a) access to rotatable reel 54 and (b) depositing the marker material into the housing 12 can be accomplished in a one step procedure of opening the movable cover 18.

Opening 40 is shown, for example, in FIG. 1B, wherein movable cover 18 is shown in an open position. In one embodiment, opening 40 is the only access to deposit chalk or marker material into housing 12, and is sufficiently large to provide the user with one or two finger access to a portion of a line 14 inside housing 12 wound on rotatable reel 54 (as best seen in FIG. 5A). In one embodiment, movable cover 18 pivots about one or more pivots 34, between open and close positions. The pivot 34 may be a pin type hinge, a living hinge formed by the elastic or elastomeric material 45, or any other type of pivot or hinge. When in a closed position, movable cover 18 seals with housing 12 to prevent leakage of chalk or marker material at an interface between movable cover 18 and housing 12. The elastic or elastomeric material 45 forming part of the cover 18 facilitates this sealing function. Movable cover 18 includes a hole or an opening 30 therethrough that provides an outlet for an elongated portion of line 14 to extend outside housing 12. In use, elongated line 14 is windable and is made of a material that facilitates the adherence of marker material thereto for marking a surface.

Elongated line 14 can be wound on rotatable reel 54 (shown in more detail, e.g., in FIGS. 1B and 5A) when reel winder 16 is operated by a user. It is to be noted that although elongated line 14 is moved in and out of housing 12 using reel winder 16, in alternative aspects elongated line 14 may be moved into the housing 12 using a one-way spring loaded winding mechanism that pulls elongated line 14 into housing 12. The elongated line 14 can be pulled out of housing 12 by a user pulling, for example, on a hook 28 attached to an end of elongated line 14 (e.g., attached at a distal end of elongated line 14). This may be facilitated by the user pushing in on the spring biased hub portion 26, as will be described later. In yet another alternative aspect, elongated line 14 can be wound or unwound using a small battery operated motor attached to and/or inside housing 12.

Housing 12 can be formed of a plastic, or other suitable material, and optionally includes an overmolded covering 32 made, for example, of an elastomeric material, on a side surface to facilitate easy gripping by a user. The covering 32 may also optionally include one or more undulations or grooves 32*a*-32*c* for easy gripping.

Referring to FIG. 1B, another view of chalk box 10 with movable cover 18 in an open position to expose opening 40 in housing 12 is shown. In one embodiment of the disclosure, opening 40 has an area of at least 1⅜ square inches. For example, in one embodiment, opening 40 has a length of 1 inch and a width of 1⅜ inches, or vice-versa. In another embodiment, the opening 40 is greater than 2 square inches. In another embodiment, the opening 40 is greater than 3 square inches. In another embodiment, the opening is greater than 4 square inches. As shown in FIG. 5A, the line 14 typically has an extending portion 14*a* that extends generally tangentially from the reel 54, and a wound portion 14*b* that is wound on the reel 54. In some instances, the line 14 may break such that the line 14 becomes entirely contained within the housing 12. Opening 40 in housing 12 is positioned and sized to enable a user to manually engage with a finger (or two fingers) through the opening 40, the portion 14*a* of elongated line 14 to enable the user to pull on the line 14 and re-thread it through opening 40. For example, in one embodiment, opening 40 is sized to provide the user with one or two finger access to a portion of the elongated line 14 wound on the reel within housing 12 (e.g., portion 14*b* of elongated line 14, also shown in FIG. 5A). If two finger access is permitted, the user can pinch portion 14*b* of line 14 that may be on reel 54 to draw it out of housing 12 if the line 14 is broken and wrapped onto reel 54. Additionally, opening 40 permits chalk or other marker material to be placed into housing 12.

In one embodiment, portion 14*a* of elongated line 14 may optionally be supported by an optional support member 38 (shown in FIGS. 1B and 5A) that facilitates guiding elongated line 14 through hole or opening 30 on movable cover 18 by providing an outlet to elongated line 14. Support member 38 may also serve to connect housing halves 13 and 15, as seen and described with respect to FIG. 5A. The elongated line 14 is wound up on rotatable reel 54 such that the chalk or marker material covers portions 14*a* and 14*b* before elongated line 14 is pulled out from hole 30 of movable cover 18 for marking a surface using chalk box 10.

As best seen in FIG. 1B, the movable cover 18 may also include a backing portion 44 made of a material relatively harder and/or more rigid than the elastomeric material 45 of the movable cover 18. In one embodiment, the elastomeric material 45 is overmolded onto and thus permanently connected to the relatively rigid material forming portion 44 of the movable cover 18. By way of example only and not by way of limitation, the relatively rigid material is a plastic, for example, an Acrylonitrile Butadiene Styrene (ABS) plastic. As can be appreciated from FIG. 1B and the cross-sectional view of FIG. 8, the more rigid portion 44 of cover 18 can be over-molded with the more resilient or elastomeric material 45 of the cover 18 (for example, in a two-shot molding process). As can be best seen in FIG. 1B, the elastomeric material 45 is molded on top and around rigid portion 44. In one embodiment, elastomeric material 45 covers an entire exterior surface of movable cover 18. In one embodiment, an entire periphery 47 (also referred to as a peripheral elastic portion 47) of the cover 18 is molded with a thickened portion of elastomeric material 45. That thickened elastomeric portion making the periphery 47 projects from the more rigid portion of the cover 18 and is received within a peripheral groove 49 formed in the housing and surrounding the opening 40 within the housing 12. The peripheral elastic portion 47 and peripheral groove 49 form a sealed interface by compressing the peripheral elastic portion 47 between the cover 18 and the housing 12 when the cover 18 is locked in the closed position to fit tightly into the groove 49. As can also be appreciated from FIG. 1B, the projection or tab 24 is formed as an extension of the elastomeric material 45 beyond the structural area of more rigid portion 44. This permits projection 24 to be manually stretched by the user during a locking operation of cover 18, as will be described in FIGS. 2-8. As noted previously, the elastomeric material 45 may be formed from rubber, or other suitable material, while more rigid portion 44 may be formed from plastic, for example, Acrylonitrile butadiene styrene (ABS), or other suitable material. Portion 44 may include a cylindrical receptacle 46 extending into the housing 12 when cover 18 is closed. Receptacle or recess 46 is arranged to hold a seal structure 58 that aids in maintaining a steady pass through of portion 14*a* of elongated line 14 through hole 30. In addition, seal structure 58 may serve to create a seal about the line 14 to prevent leakage of marker material between the line 14 and a lip 31 surrounding the hole 30. This is accomplished as a result of the narrow passage formed in the seal structure 58, which may be formed from felt or felt like material. The line may pass through the narrow passage in the seal structure 58. In one embodiment, the seal structure 58 can be made of a sponge-like material and portion 44 can be made of same material as that used for housing 12. A clip 56 is optionally arranged to facilitate passage of the line portion 14*b* through the passage in the seal structure 58, although in some examples clip 56 may be omitted. Receptacle part 46 can be hollow to receive the seal structure 58, and include one or more cut-out grooves 70 to facilitate removal of the seal structure 58 if desired, for example, if rethreading a broken line 14 through the passage in the seal structure 58 is performed. In FIG. 1B, projection 24 includes the recess 37 through which protrusion 36 passes through, as described in more detail below, to form a releasable lock mechanism for movable cover 18.

Figure 2:
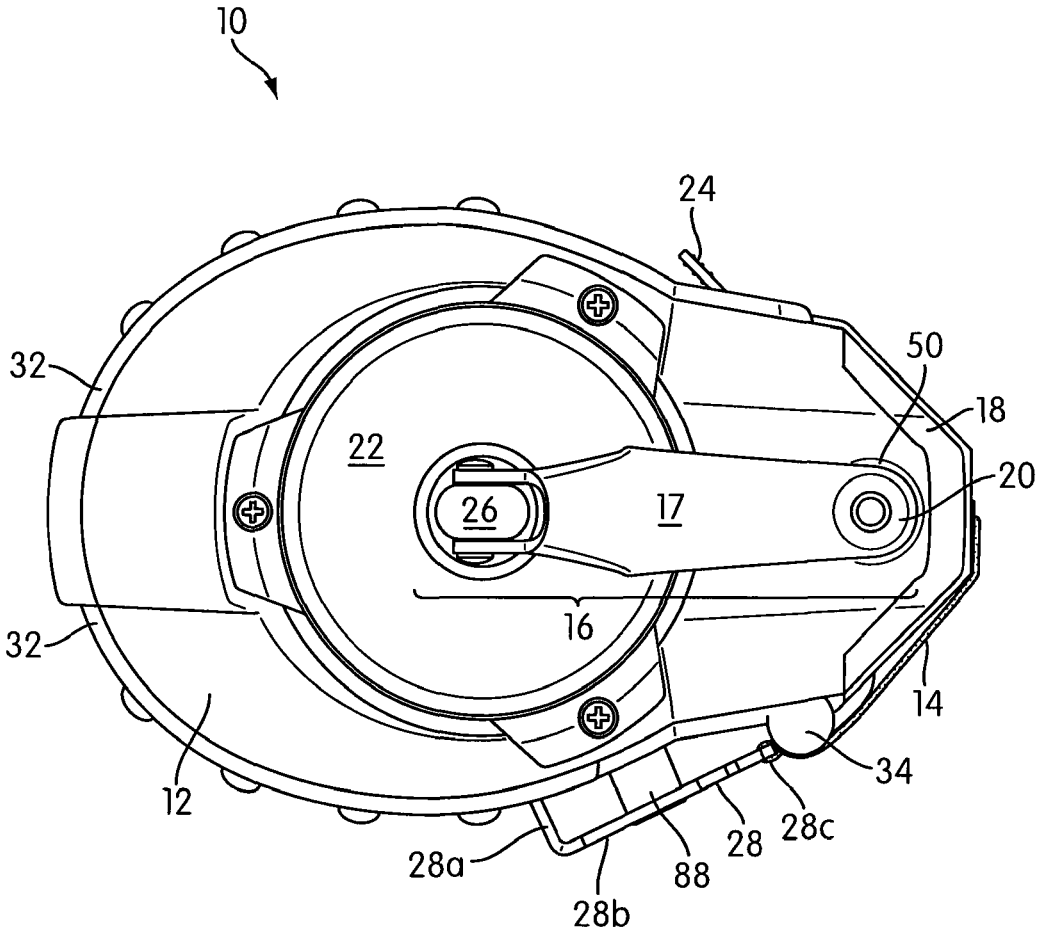
FIG. 2 shows a side view of the chalk box, in accordance with an aspect of the present disclosure.

FIGS. 2 and 3 are side views and front views of chalk box 10, respectively. Elements of FIG. 2 are substantially similar to the elements shown in FIGS. 1A and 1B except a side view of hook 28 is shown in more detail. When chalk box 10 is not in use, hook 28 rests over a protrusion 88, although other mechanisms for resting hook 28 may be used (e.g., a snap-on clip). Alternatively, protrusion 88 may be optional and hook 28 may hang from chalk box 10. Referring to FIG. 3, another view of hook 28 is shown in detail. Hook 28 may include one or more claws 28*a* for fixing elongated line 14 to an end point, in use. Additionally, hook 28 may include a through-hole 28*c* for fastening elongated line 14, and another hole 28*b* for hanging chalk box 10, for example, on a nail in a wall for storage. Alternatively, hole 28*b* may also be used to fix elongated line 14 to a projecting member or a work-piece where more suitable than claws 28*a*. Hole 28*b* may also be used to attach hook 28 to housing 12 over protrusion 88 (shown in FIG. 2), when chalk box 10 is not in use. FIG. 3 also illustrates an additional housing cap 22' on a side of housing 12 opposite to a side where reel winder 16 is arranged on housing cap 22. Additional cap 22' is optional and is arranged to enhance structural strength of chalk box housing 12.

Figure 4:
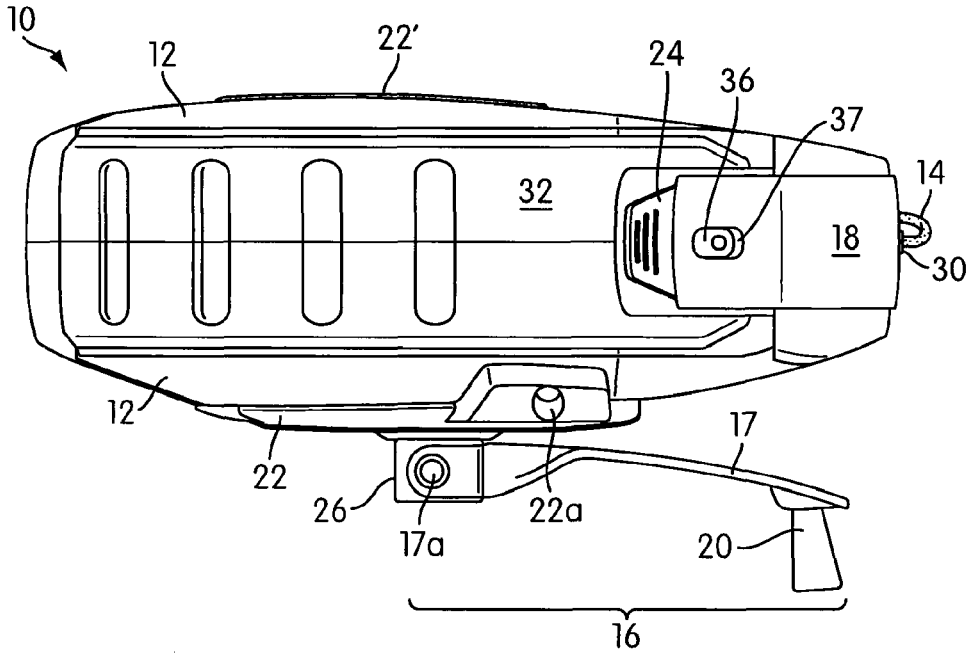
FIG. 4 shows a top view of the chalk box with a reel winder of the chalk box in an operating position, in accordance with an aspect of the present disclosure.

FIG. 4 is a top view of chalk box 10 with handle 20 of reel winder 16 shown in an operational position in contrast with the "at rest" position shown in FIG. 1A, for example. In the operational position, handle 20 faces away from housing 12 for a user to grip handle 20 and wind the reel winder 16 to rotate reel 54 to take-up the line 14 and wind it into the reel 54. Reel winder 16 can be bought in the position shown in FIG. 4 by pivoting the elongated part 17 about fastener 17*a*.

Also in FIG. 4, protrusion 36 is shown. In one embodiment, the resilient projection 24 formed on pivotable cover 18 can be engaged by a user's fingers to move cover 18 to a closed position. Projection 24, when stretched, can enable the opening 37 in the elastomeric material 45 of cover 18 to be pulled to a position in which it can be placed over protrusion 36 to releasably lock cover 18 in the closed position. To release the lock, the projection 24 is stretched in a direction away from movable cover 18 to release projection 24 from the protrusion 36. This will unlatch or unlock movable cover 18 and enable it to be moved to an open position shown, for example, in FIG. 1B.

FIG. 5A is an exploded view of chalk box 10 showing internal and external structural arrangement details thereof, in accordance with one aspect of this disclosure. Starting from the left in FIG. 5A, elongated part 17 of reel winder 16 includes a pair of holes 17*b* to accommodate a fastener 17*a*. Fastener 17*a* also goes through a hole 17*c* on mounting hub 26 causing mounting hub 26 to be attached securely to elongated part 17 of reel winder 16. Housing cap 22 includes a hole 22*d* that accommodates the pivot structure 19 (which includes the cylindrical portion 27 attached to the mounting hub portion 26). Pivot structure 19 also includes the gear member 60 with teeth 63 and a circular portion 62. Member 60 is received into a similarly shaped hole 23*a* on an inner ring gear 23 rotatably received within housing cap 22, as illustrated in FIG. 5A. Also shown are plurality of screws 22*a*-22*c* that fit into their respective grooves as shown by the corresponding chained lines parallel to respective major axes of the screws. In this embodiment, screws 22*a*-22*c* extend through their respective grooves, via respective receptacles 12*c*, 12*b*, and 12*d*, into three cylindrical fastener receiving protrusions 12*e*, 12*f*, and 12*g* on the interior surface of a housing half 15 to hold housing halves 13 and 15 of housing 12 together.

Circular portion 62 has a receptacle or stud that receives one end of a spring 64, the spring 64 having a second end that fits into or on a receptacle 12*a* formed on housing half 13. In one embodiment, receptacle 12*a* is a stud (as shown in FIG. 5A) that extends into the coils of spring 64, although in alternative aspects, receptacle 12*a* may be a groove or a recess that receives the spring 64. Receptacle 12*a* secures spring 64 such that when the end of mounting hub 26 is manually pushed inwards, mounting hub 26 compresses spring 64.

Receptacle 12*a* also serves as an axle for rotation of the pivot structure 19. The rotation of pivot structure 19 (by manual rotation of handle 20 of reel winder 16) causes rotation of teeth 63, which engages with correspondingly shaped hole 23*a* in the ring gear 23, to rotate the ring gear 23, as will be appreciated by also looking at FIG. 5B described below. Spring 64 is biased to normally retain teeth 63 at an axial position in which it is aligned to engage with hole 23*a*. However, the pivot structure 19 can be manually pushed inwards by manually pushing in on the end of mounting hub 26 against the bias of spring 64. This axial movement of the pivot structure 19 moves the teeth 63 out of engagement with correspondingly shaped hole 23*a*. As a result, in this position, rotation of the inner ring gear 23 will not cause rotation of the pivot structure 19 or the reel winder 16. This may be desirable when line 14 is manually pulled out of the housing 12, to extend the line, so that rotation of reel 54 during this action does not cause rotation of the reel winder 16.

Figure 5B:
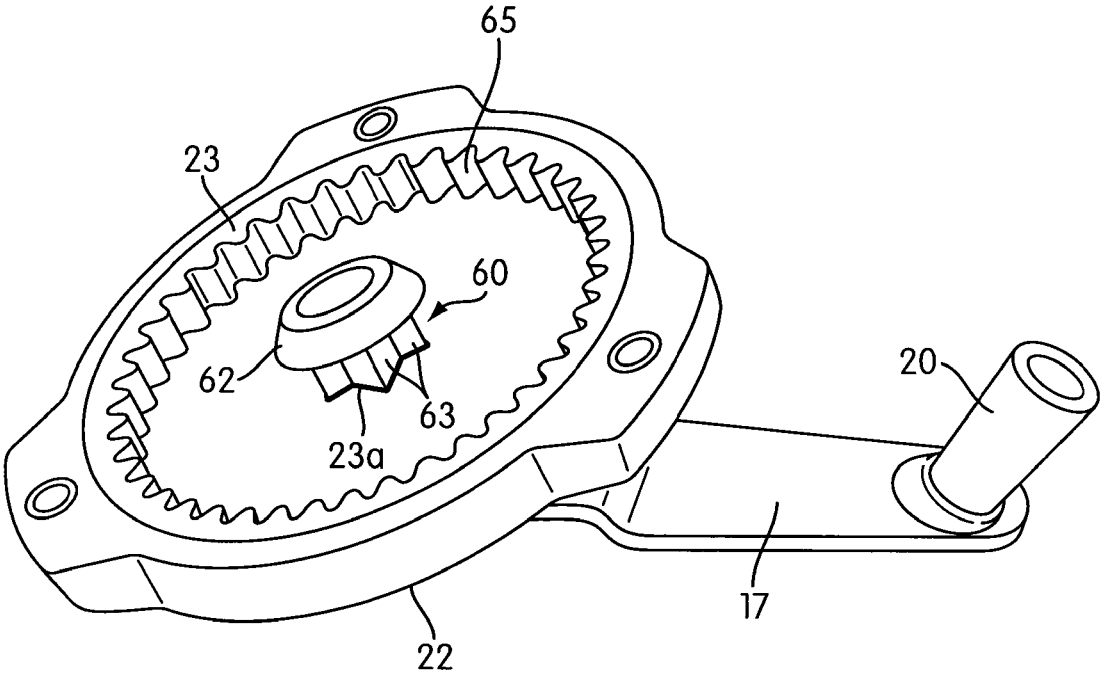
FIG. 5B shows an inner view of a gear member arrangement that rotatably attaches to a reel winder (illustrated in FIG. 5A), in accordance with an aspect of the present disclosure.

FIG. 5B shows inner ring gear 23 with teeth 65 in more detail when looking at a side of ring gear 23 facing a hole 12*h* in housing half 13. As best seen in FIG. 5B, through hole 12*h* on housing half 13, the teeth 74 of a gear structure 75 fit through to mesh with the teeth 65 of ring gear 23. When reel winder 16 is rotated, rotational motion is transferred via pivot structure 19 to ring gear 23. In one embodiment, during rotation of ring gear 23, teeth 65 of ring gear 23 mesh with teeth 74 of gear structure 75 and thus rotate gear structure 75.

Referring back to FIG. 5A, gear structure 75 also has a disc-shaped portion 78 having an axial extension 80 that fits into a correspondingly shaped hole 54*a* of rotatable reel 54. Rotation of gear structure 75 thus in turn transfers its rotational motion to rotatable reel 54 via axial extension 80 fitted into hole 54*a*.

Rotatable reel 54 is shaped to have two extended discs 54*a* and 54*b* connected to one another by a central hub (hidden from view in FIG. 5A by a portion 14*b* of elongated line 14 that is wound on the central hub by discs 54*a*, 54*b*). Elongated line 14 is extended at portion 14*a* tangentially from the central hub. Upon application of a pulling force P on hook 28 by a user, portion 14*a* straightens out and applies a rotation force to the central hub of reel 54. The central hub of reel 54 can thus be rotated when the line 14 is pulled.

Support member 38 extends between and is connected to housing halves 13 and 15. The ends of support member 38 fit into a pair of recesses or grooves 38*a* inside housing 12, in the respective housing halves 13, 15 (only one of the pair of grooves 38*a* being shown in FIG. 5A). Member 38 may be formed of a metal or other rigid material. Portion 14*b* extends through the seal structure 58 made of a soft or flexible material and held in cylindrical shape by clip 56, although other shapes may be used as can be contemplated by one of ordinary skill in the art.

Housing 12 includes the one or more pivots or hinges 34 for movable cover 18. In particular, cover 18 has a pivot pin receiving through-hole 34*a*, while housing halves 13, 15 each have pivot pin receiving recesses 34*b*. A pivot pin may be inserted through hole 34*a* and recess 34*b* to enable pivoting movement of cover 18. As noted earlier, movable cover 18 moves about or pivots about hinge or pivot 34 between open and closed positions.

Recess 50 shown on housing 12 accommodates the distal end of handle 20 when reel winder 16 is not in use, or when chalk box 10 is not in use. Housing half 15 includes three cylindrical fastener receiving protrusions 12*e*, 12*f*, and 12*g* that support housing halves 13 and 15 by receiving screws 22*a*-22*c*, respectively. Cylindrical protrusions 12*e*, 12*f*, and 12*g* may be configured to receive additional screws (e.g., screw 22*a*') to provide additional support for securing housing halves 13 and 15 together. Additionally, a cylindrical hollow protrusion 12*i* formed on the interior surface of housing half 15 supports positioning of and smooth rotation of rotatable reel 54 thereabout. In particular, the reel 54 has a cooperative projection or recess (not seen in FIG. 5A) that acts as an axle that rotatably engages with protrusion 12*i*.

Figure 6:
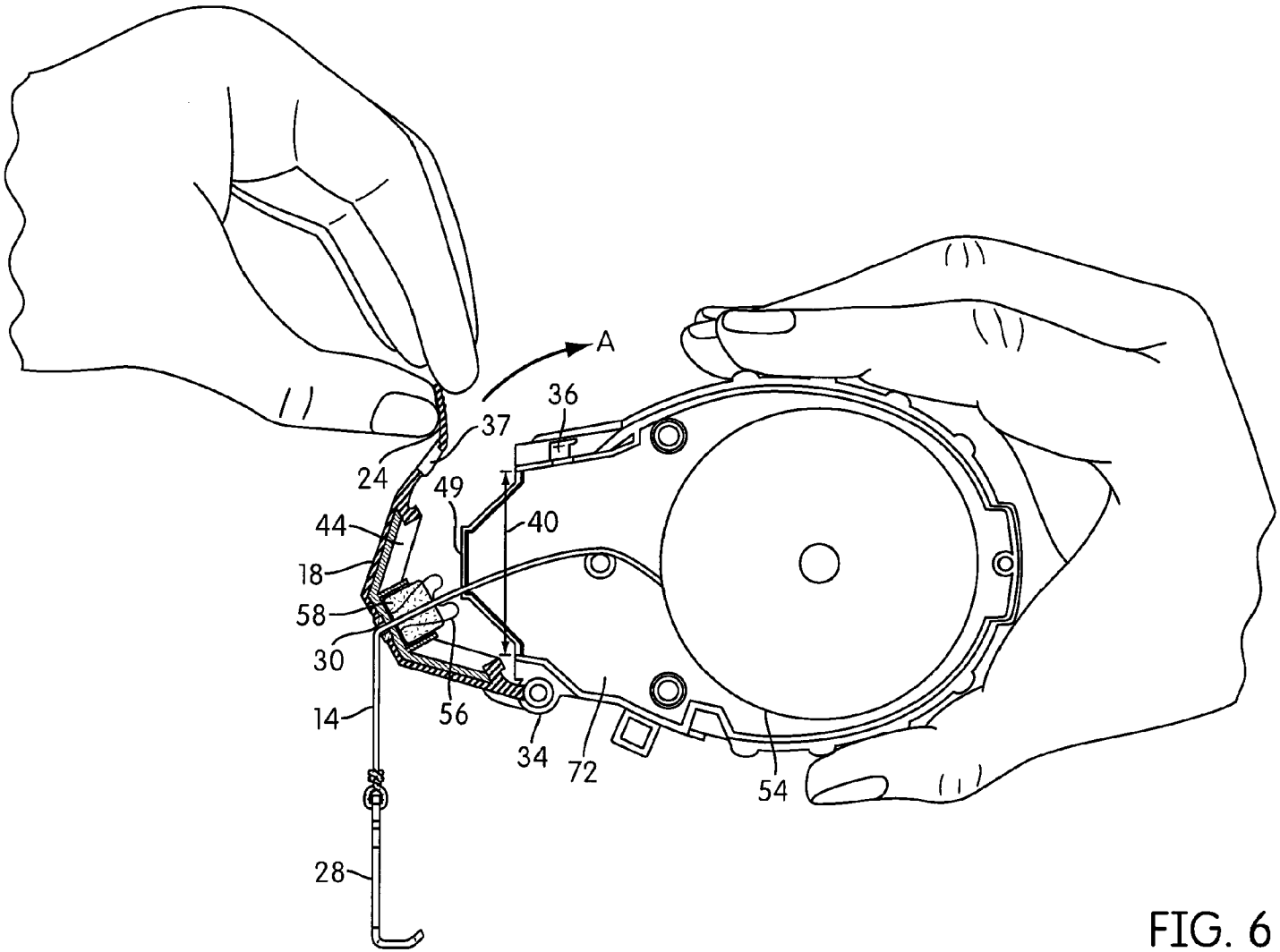
FIG. 6 shows a partial cross sectional view of the chalk box with a movable cover mounted on a housing of the chalk box and movable between open and closed positions by a user's hands.

FIG. 6 shows an operation of moving pivotable cover 18 to a closed position by a user. For example, the user's fingers are shown pulling on projection 24 in a direction A shown by an arrow to move movable cover 18 in a direction such that opening 37 in the cover 18 can be placed over protrusion 36 on housing 12. As a result, opening 40 can be closed to seal an inside or an interior portion 72 of housing 12.

In FIG. 7, the user pulls or stretches projection 24 on movable cover 18 to align recess or hole 37 thereon with protrusion 36 on housing 12. The user pulls the projection 24 in a direction A' shown by an arrow such that projection 24 can latch on to protrusion 36 by stretching projection 24 (also made of elastomeric material) forming a releasable lock arranged to releasably lock movable cover 18 in the closed position. The elasticity of the projection 24 allows for such stretching and retains the edge around opening 37 in forced engagement. Further, the releasable lock formed by such arrangement of protrusion 36 and projection 24 is manually manipulable by a user's fingers to release the lock to permit access into housing 12. The releasable lock formed by such arrangement of protrusion 36 and projection 24 uses opening 37 to securely seal chalk or marker material inside housing 12.

FIG. 8 shows a close-up view of arrangement of projection 24 on movable cover 18 over protrusion 36 on housing 12 at hole 37 in projection 24. A lip 36*a* on protrusion 36 interlocks with the opening 37 in projection 24, now stretched, to maintain movable cover 18 in a closed position and prevent leakage of chalk or marker material from inside of housing 12. As a result, movable cover 18 securely seals chalk or marker material within housing 12. The open and close positions of movable cover 18 selectively permit or prevent access to interior portion 72 of housing 12 through opening 40.

It is to be noted that although in this example, particular shapes and sizes of various elements of chalk box 10 are described, one of ordinary skill in the art after reading this disclosure can contemplate other shapes and sizes of various components of chalk box 10. For example, various holes and gears may be square or other suitable geometric cross-sectional shapes and can be made larger or smaller. In one example, marker material may be in a powder form. Alternatively, marker material may be a fluid material (e.g., a liquid, a paste, or the like) that can be placed into housing 12 when movable cover 18 is in an open position.

Although aspects of chalk box 10 have been described in detail for the purpose of illustration, it is to be understood that such detail is solely for that purpose and that the disclosure is not limited to the disclosed aspects, but, on the contrary, is intended to cover modifications and equivalent arrangements that are within the spirit and scope of the appended claims. In addition, it is to be understood that the present disclosure contemplates that, to the extent possible, one or more features of any aspect can be combined with one or more features of any other aspect.

What is claimed is:

1. A chalk box, comprising:

a housing with an opening;

a rotatable reel disposed within the housing;

an elongated line arranged to be wound on the reel;

a reel winder arranged to rotate the reel to wind the line on the reel;

a movable cover mounted to the housing and being movable between an open position and a closed position, the movable cover when open permitting a powder or a fluid marker material to be placed into the housing through the opening in the housing, the movable cover comprising an elastomeric material and a relatively rigid material, the elastomeric material enabling the movable cover to seal with the housing when the movable cover is closed to prevent leakage of the marker material at an interface between the movable cover and the housing; and a releasable lock arranged to releasably lock the movable cover in the closed position, the releasable lock being manually manipulable by a user's fingers to release the lock to permit access into the housing through the opening, and wherein the elastomeric material is overmolded onto and thus permanently connected to the relatively rigid material of the movable cover, wherein the movable cover is the sole cover provided on the housing.

2. The chalk box of claim 1, wherein the opening in the housing is the only access to deposit the marker material into the housing, and wherein the opening is sufficiently large to provide the user with finger access to the line wound on the reel within the housing.

3. The chalk box of claim 2, wherein the opening has an area of at least 1⅜ square inches.

4. The chalk box of claim 2, wherein both (a) an access to the reel and (b) depositing the marker material into the housing can be accomplished in a one step procedure of opening the movable cover.

5. The chalk box of claim 1, wherein the movable cover is pivotally mounted to the housing.

6. The chalk box of claim 1, wherein the elastomeric material covers an entire outer surface of the movable cover.

7. The chalk box of claim 1, wherein a projecting portion of the elastomeric material on the movable cover forms a manually engageable tab that facilitates an opening of the movable cover.

8. The chalk box of claim 1, wherein the releasable lock comprises a protrusion formed on the housing and a recess formed on the movable cover.

9. The chalk box of claim 1, wherein the relatively rigid material is a plastic.

10. The chalk box of claim 9, wherein the plastic is an Acrylonitrile Butadiene Styrene (ABS) plastic.

11. A chalk box, comprising:

a housing with an opening;

a rotatable reel disposed within the housing:, an elongated line arranged to be wound on the reel;

a reel winder arranged to rotate the reel to wind the line on the reel;

a movable cover mounted to the housing and being movable between an open position and a closed position, the movable cover when open permitting a powder or a fluid marker material to be placed into the housing through the opening in the housing, the movable cover comprising an elastomeric material and a relatively rigid material, the elastomeric material enabling the movable cover to seal with the housing when the movable cover is closed to prevent leakage of the marker material at an interface between the movable cover and the housing; and a releasable lock arranged to releasably lock the movable cover in the closed position, the releasable lock being manually manipulable by a user's fingers to release the lock to permit access into the housing through the opening, and wherein the elastomeric material is overmolded onto and thus permanently connected to the relatively rigid material of the movable cover, wherein the movable cover comprises a hole through which the elongated line extends from the interior to the exterior of the housing.

12. A chalk box, comprising:

a housing having an opening;

a movable cover attached to the housing, the movable cover arranged to move between an open position and a closed position to selectively permit or prevent access to an interior of the housing through the opening;

a rotatable reel within the housing; and a windable line having a portion thereof wound on the reel and another portion thereof extending through a hole in the movable cover to the outside of the housing, wherein the opening in the housing is positioned and sized to enable the user to manually engage the portion of the line wound on the reel therethrough when the cover is in the open position, the opening also permitting chalk or other marker material to be placed into the housing therethrough when the cover is in the open position, and wherein the opening has an area of at least 1⅜ square inches.

13. The chalk box of claim 12, wherein the movable cover is pivotably attached to the housing to move between the open and the closed positions.

14. The chalk box of claim 13, wherein the movable cover comprises an elastomeric material, the elastomeric material comprising a projection that can be manually stretched by the user's fingers over a protrusion on the housing to enable the movable cover to be locked in the closed position.

15. The chalk box of claim 14, wherein the cover further comprises a relatively rigid backing material attached to the elastomeric material.

16. The chalk box of claim 12, wherein at least a portion of the housing is covered with the elastomeric material for mechanical protection of the housing and to enable the user to grip the housing over one or more grooves provided on the elastomeric material on the portion of the housing.

17. The chalk box of claim 12, further comprising a reel winder, the reel winder including a handle mounted on the exterior of the housing, the reel winder, in use, arranged to wind or unwind the reel for varying a length of the line outside the housing.

18. The chalk box of claim 12, further comprising a hook attached to a distal end of the line.

19. A chalk box, comprising:

a housing with an opening, the housing having a first lock portion;

a rotatable reel disposed within the housing;

an elongated line arranged to be wound on the reel;

a reel winder arranged to rotate the reel to wind the line on the reel;

a pivotable cover mounted to the housing and being movable between an open position and a closed position, the pivotable cover having an opening therethrough to provide an outlet for the line, the pivotable cover when open permitting a powder or a fluid marker material to be placed into the housing through the opening in the housing, the pivotable cover having a second lock portion; and a releasable lock formed by the first and second lock portions, the releasable lock arranged to releasably lock the cover in the closed position, the releasable lock being manually manipulable by a user's fingers to release the lock to permit access into the housing, wherein at least a portion of the pivotable cover is made of an elastomeric material such that the elasticity of the at least a portion of the pivotable cover enables the second lock portion of the pivotable cover to be engaged with the first lock portion of the housing to releasably lock the cover in the closed position.

20. The chalk box of claim 19, wherein the at least a portion of the pivotable cover comprises an elastic tab formed on the cover, the elastic tab having an opening that can receive a protrusion formed on the housing.

21. The chalk box of claim 19, wherein the at least a portion of the pivotable cover is constructed and arranged to enable the pivotable cover to seal with the housing when the cover is closed to prevent a leakage of the marker material at an interface between the pivotable cover and the housing.

* * * * *